US007000286B2

(12) United States Patent
Wang

(10) Patent No.: US 7,000,286 B2
(45) Date of Patent: Feb. 21, 2006

(54) WATER ABSORBING AND DRYING CLEANER

(76) Inventor: Donglei Wang, No. 4 Workshop Building, Pinglanyuan Industrial Zone Nanping Town, Zhuhai, Guangdong Province (CN)

( * ) Notice: Subject to any disclaimer, the term of this patent is extended or adjusted under 35 U.S.C. 154(b) by 318 days.

(21) Appl. No.: 10/188,005

(22) Filed: Jul. 1, 2002

(65) Prior Publication Data

US 2003/0014829 A1 Jan. 23, 2003

(30) Foreign Application Priority Data

Jul. 17, 2001 (CN) ..... 01242734 U

(51) Int. Cl.
*A47L 11/30* (2006.01)

(52) U.S. Cl. ..... 15/320
(58) Field of Classification Search ..... 15/320, 15/321

See application file for complete search history.

(56) References Cited

U.S. PATENT DOCUMENTS

| | | | | |
|---|---|---|---|---|
| 5,169,445 | A * | 12/1992 | Yonehara et al. | 118/63 |
| 5,502,872 | A * | 4/1996 | Chae et al. | 15/320 |
| 5,797,163 | A * | 8/1998 | Whitaker et al. | 15/413 |
| 5,813,086 | A * | 9/1998 | Ueno et al. | 15/320 |
| 6,446,302 | B1 * | 9/2002 | Kasper et al. | 15/319 |
| 6,560,817 | B1 * | 5/2003 | Deiterman et al. | 15/320 |
| 2002/0184730 | A1 * | 12/2002 | Allen et al. | 15/346 |

* cited by examiner

*Primary Examiner*—Terrence R. Till
(74) *Attorney, Agent, or Firm*—Buchanan Ingersoll LLP

(57) ABSTRACT

A water absorbing and drying cleaner comprises a washing apparatus and a drying apparatus, wherein the washing apparatus and the drying apparatus are mounted in the casing of the water absorbing and drying cleaner, a drying inlet in the drying apparatus and a washing inlet in the washing apparatus are provided at the bottom of the water absorbing and drying cleaner along the progressive direction in washing, and the drying inlet is located behind the washing inlet. The invention has the features of novel in structure, clean in washing and fast in drying, can kill the acarids and other bacteria on the carpet or wooden floor to perform sterilization.

11 Claims, 3 Drawing Sheets

WATER ABSORBING AND DRYING CLEANER

The present invention relates to a cleaner device for cleaning and drying a carpet or floor.

BACKGROUND OF THE INVENTION

Current commercial water absorbing cleaner devices, conventionally only absorb about 60%–90% of the water on the carpet or floor, and after cleaning, the surface of the carpet or floor is still wet. Sometimes the surface of indoor carpets or floors will not have dried even after several days, and growth of acaroids and other bad bacteria is encouraged in the wet carpet, thereby tending to contaminated the environment and adversely affect human health.

SUMMARY OF THE INVENTION

An object of the invention is to provide a water absorbing and drying cleaner device that is able to perform fast drying of wet carpet or floor from which water has been absorbed, carry out sterilization, protect the environment and human health, and is convenient to use.

The water absorbing and drying cleaner device of the present invention comprises a washing apparatus and a drying apparatus, both of which are mounted in a casing of the device. A water inlet of the washing apparatus and a drying outlet of the drying apparatus are installed at the bottom of the cleaner device and are arranged along the progressive direction of washing, with the drying inlet located behind the water inlet.

The washing apparatus comprises a clear water basin, a water pump, a suction motor, a sewage tank, a water line, a scrubbing unit, and a float device. The clear water basin is positioned under a handle of the cleaner device, the suction motor is mounted beneath the clear water basin, and the clear water line is joined to the water pump on the top of the clear water basin. The water pump is also connected to the suction tube in the clear water basin. The clear water line is extended from pump at the top of the clear water basin to the water jet on the head of the bottom casing along inside of the erect casing of the cleaner device and inside of the bottom casing. The sewage tank is laterally installed, in front of the lower end of the clear water basin. A ventiduct of the suction motor is interlinked to the inner chamber of the sewage tank via a float valve, and a suction inlet located on the front side of the water jet in the head end of the bottom casing, is connected to a sewage tunnel, and the sewage tunnel is interlinked with the inner chamber of the sewage tank.

The drying apparatus comprises a vane, a motor, a ventiduct, and a heater. The vane is mounted on the motor, the ventiduct is formed by an upper sheathe and lower sheathe. The heater is mounted at an upper end of the ventiduct, and the lower end of the ventiduct is connected to the drying outlet.

In operation, after an operator grasps the handle of the cleaner device to push and pull to perform the action of water injection and absorption he then turns on the drying switch, and at this time, the two D.C. motors in the drying apparatus drive the two centrifugal vanes into high speed rotation with a rotating speed of over 21,000 r.p.m., simultaneously blowing air to the heater with an extremely high wind speed. The substantial heat generated from the heater causes a strong hot airflow to be evenly blown to the wet carpet or wooden floor surface, to carry the moisture away rapidly, enabling the wet carpet or wooden floor to be air-dried. Moreover, since the temperature of the hot airflow is about 90° C., the acaroids or other bacteria on the carpet or wooden floor can be killed to perform sterilization.

The cleaner device of the present invention is thus novel in structure, clean in washing, fast in drying, and the acaroids or other bacteria on a carpet or wooden floor can be killed reliably so as to perform sterilization.

DETAILED DESCRIPTION OF PREFERRED EMBODIMENT

As shown In FIGS. 1 to 4, the reference numbers represents: 1—centrifugal vane; 2—sheathe of hot air tunnel; 3—casing grounded motor; 4—fixed base of motor; 5—base of hot air ventiduct; 6—screw; 7—heater holder; 8—heater; 9—handle; 10—top casing; 11—bobbin winder bracket; 12—plunger pump; 13—clear water line; 14—clear water basin; 15—water line; 18—erected casing; 17—power line holder; 18—clear water (or cleaning liquid); 19—pedal; 20—series motor combination; 21—roller; 22—bottom casing; 23—scrubbing unit; 24—cover of sewage tank; 25—floating device; 26—case cover; 27—sewage tank ; 28—transparent mask; 29—sewage.

Figure 1:
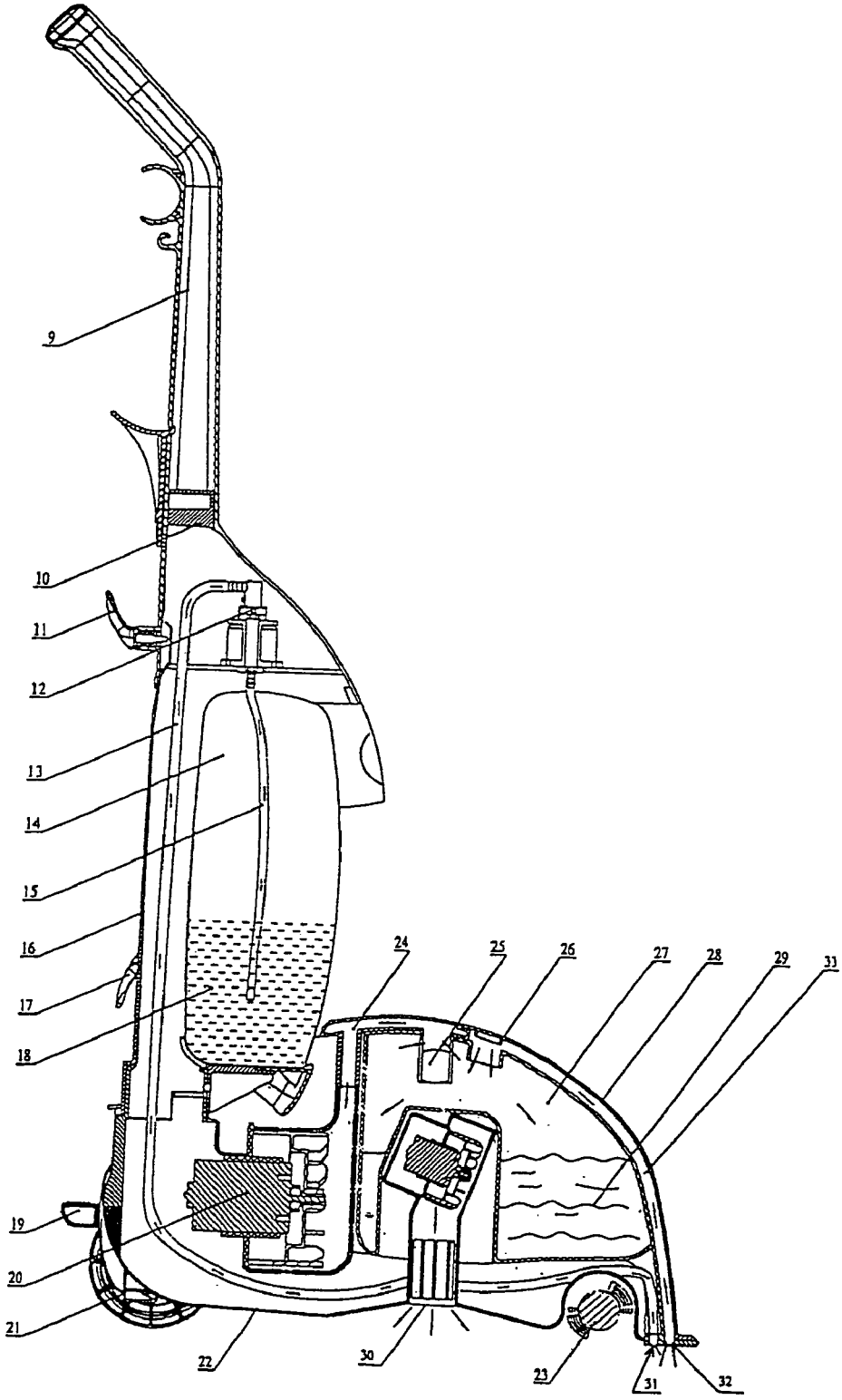
FIG. 1 is a longitudinal sectional view of a water absorbing and drying cleaner device in accordance with the present invention.

As shown in FIG. 1, the invention comprises a washing apparatus and a drying apparatus, the washing apparatus and the drying apparatus are mounted in the casing (16, 22, 28) of the water absorbing and drying cleaner device. The drying outlet 30 in the drying apparatus and the cleaning assembly (23, 31, 32) in the washing apparatus are provided on the bottom of the cleaner device and are arranged along the progressive direction of washing. The cleaning assembly (23, 31, 32) is formed by a water jet 31, a suction inlet 32, and a scrubber 23. The drying outlet 30 is located behind the cleaning assembly (23, 31, 32).

The washing apparatus comprises a clear water basin 14, a water pump 12, a suction motor 20, a sewage tank 27, water lines (13,33), a scrubbing unit 23, and a floating device 25. The clear water basin 14 is erected positioned under the handle 9 of the water absorbing and drying cleaner device, the suction motor 20 is mounted on the bottom of the clear water basin 14, and the clear water line 13 joins the water pump 12 placed on top of the clear water basin 14. The water pump 12 is also connected to the suction tube 15 in the clear water basin 14. The clear water line 13 is extended to the water jet 31 on the head of the bottom casing 22 along the inside of the erect casing 15 of the water absorbing cleaner device and inside of the bottom casing 22. The sewage tank 27 is laterally installed adjoining the lower end of the clear water basin 14. The ventiduct of the suction motor 20 interlinks with the inner chamber of the sewage tank 27 via a float valve 25, and a sewage tunnel 33 is connected to the suction inlet 32 located on the front side of the water jet 31 at the head of the bottom casing 22. The sewage tunnel 33 is interlinked with the inner chamber of the sewage tank 27. A series motor is employed for suction motor 20. The cleaning assembly (23,31,32) is formed by a water jet 31, a suction inlet 32, and a scrubber 23. The sewage tunnel 33 is separated to form by a laterally disposed mask 28 or the water absorbing and drying cleaner device and the wall of the sewage tank 27. The float valve 25 is arranged between the ventiduct of the suction motor 20 and the inner chamber of the sewage tank 27. The suction inlet 32 is provided at the front end of the bottom casing 22. The water jet 31 is set inwards adjoining it, then the scrubbing unit 23 is arranged adjoining the water jet 31, and a drying outlet 30 is provided between the scrubbing unit 23 and the roller 21 arranged at the end of the bottom casing 22.

Figure 2:
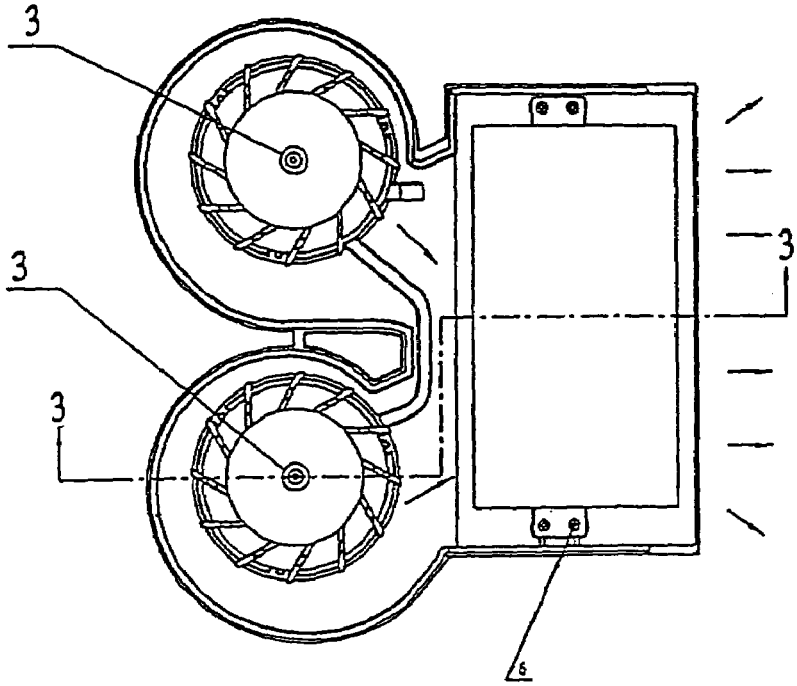
FIG. 2 is a structural schematic view of the drying apparatus in the unit of FIG. 1.
Figure 3:
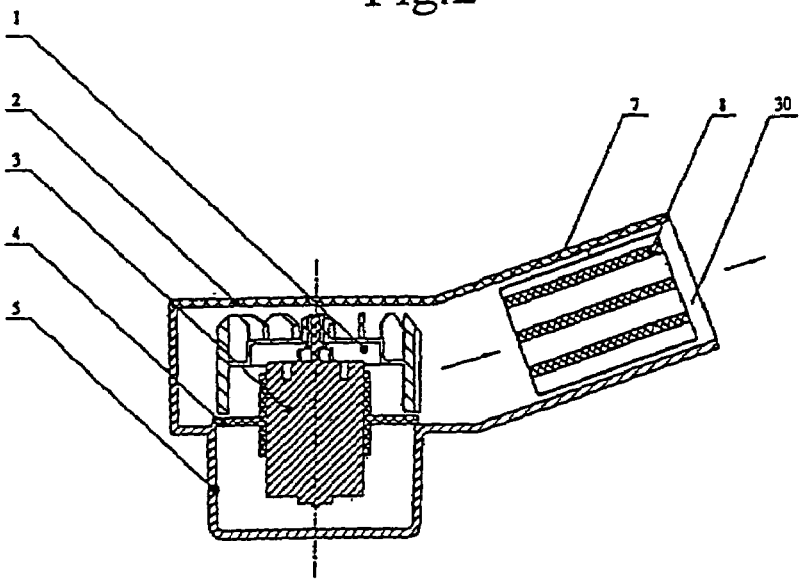
FIG. 3 is a sectional view taken along line 3—3 of FIG. 2.

As shown in FIGS. 2 and 3, the drying apparatus comprises a vane 1 a motor 3, a ventiduct, a heater 8. The vane 1 is mounted on the motor 3, the ventiduct is surrounded by an upper sheathe 2, lower sheathe 5, the heater B is mounted at the end of the ventiduct, which is Joined with the drying outlet 30. The drying apparatus is disposed at a recess of the sewage tank 27, and the heater 8 employs a heating wire or a heating pipe or a photoelectric cell or a quartz capsule.

Figure 4:
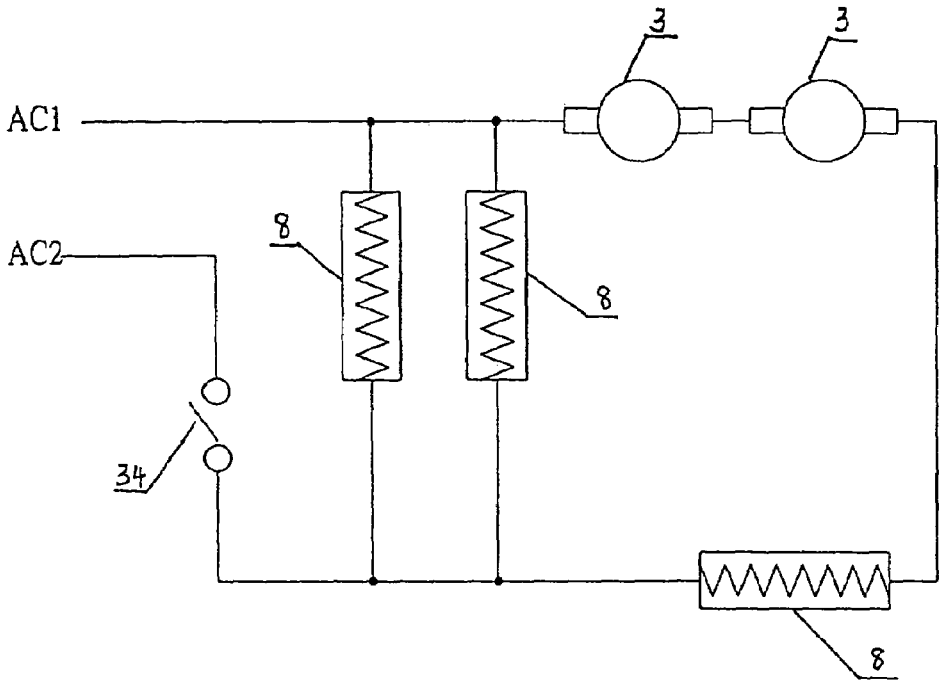
FIG. 4 is a circuit diagram of the drying apparatus of FIGS. 2 and 3.

As shown in FIG. 4, a circuit of the drying apparatus is formed in connection of two motors 3 three heaters 8 and a switch 34.

The operation of the cleaner device of the present invention is as follows: as shown in FIGS. 1 to 3, the clear water (or cleaning liquid) 18 in the clear water basin 14 is drawn by the water pump 12, sprayed on the carpet or wooden floor via the suction pipe 15 and water line 13 to complete water injection; the series motor 20 generates negative pressure, enables the sewage on the carpet or wooden floor driven by the scrubbing unit 23 to be delivered into the sewage tank 27 via the tunnel between the transparent mask 28 and the sewage tank 27. The float device 25 is used to prevent overfilling of the sewage tank 27. The case cover 26 blocks the intake opening to sewage tank 27 when the mopping device is not in use. The centrifugal vane 1 is brought to high speed rotation by D.C. motor 3 to blow the hot airflow generated by the heating wire (or heating pipe) 8 towards the surface of a carpet or wooden floor, and drying is completed. Alternatively, the heating wire or heating pipe for heat generation heater 8 of the drying apparatus can be replaced by a photocell or quartz capsule for heat generation to perform surface drying of the carpet or wooden floor.

While the specification describes particular embodiments of the present invention, those of ordinary skill can devise variations of the present invention without departing from the inventive concept.

I claim:

1. A water absorbing and drying cleaner device, comprising: a washing apparatus including a sewage tank; and a drying apparatus located at a recess of the sewage tank and mounted in a casing, the drying apparatus including a motor, a vane mounted on the motor, a ventiduct formed by an upper sheathe and a lower sheathe, and a heater mounted at one end of the ventiduct, said one end forming a drying outlet, the drying outlet of the drying apparatus and a washing inlet of the washing apparatus being provided at the bottom of the casing along the progressive direction in washing, the drying outlet being located behind the washing inlet.

2. A water absorbing and drying cleaner device according to claim 1, wherein a heating wire is used as the heater.

3. A water absorbing and drying cleaner device according to claim 1, wherein an electric heating pipe is used as the heater.

4. A water absorbing and drying cleaner device according to claim 1, wherein a photoelectric cell is used as the heater.

5. A water absorbing and drying cleaner device according to claim 1, wherein a quartz capsule is used as the heater.

6. A water absorbing and drying cleaner device according to claim 1, wherein the washing apparatus further includes: a clear water basin, a water pump, a suction motor, a water line, a scrubbing unit, and a float valve device, the clear water basin being mounted under a handle of the water absorbing cleaner device, the suction motor being mounted beneath the bottom of the clear water basin, the clear water line being joined to the water pump which is connected to a suction tube in the clear water basin, the clear water line being extended to a water jet at the head end of a bottom part of the casing and extending along the inside of the casing, the sewage tank being laterally installed adjoining the lower end of the clear water basin, the suction motor being interlinked to the inner chamber of the sewage tank, a suction inlet located adjacent to the water jet at the head of the bottom part of the casing being connected to a sewage tunnel, and the sewage tunnel being interlinked with the inner chamber of the sewage tank.

7. A water absorbing and drying cleaner device according to claim 6, wherein a series motor is employed as the suction motor.

8. A water absorbing and drying cleaner device according to claim 6, wherein the washing apparatus further includes the water jet and the suction inlet.

9. A water absorbing and drying cleaner device according to claim 6, wherein the sewage tunnel is formed by a part of the casing of the water absorbing and drying cleaner device and a part of the wall of the sewage tank.

10. A water absorbing and drying cleaner device according to claim 6, wherein a float valve is arranged between the suction motor and the inner chamber of the sewage tank.

11. A water absorbing and diving cleaner device according to claim 6, wherein the suction inlet is provided at the front end of the bottom of the casing, a water jet is provided inwardly adjoining the suction inlet, a scrubbing unit is arranged adjoining the water jet, and a drying outlet is provided between the scrubbing unit and a roller arranged at the rear end of the bottom of the casing.

* * * * *